US006484336B1

(12) United States Patent
Berke et al.

(10) Patent No.: US 6,484,336 B1
(45) Date of Patent: Nov. 26, 2002

(54) ORTHOPEDIC SIDE SLEEPER COMFORT PILLOW AND METHOD

(75) Inventors: Joseph J. Berke, 3248 Interlaken, West Bloomfield, MI (US) 48323; Charles T. Michael, Troy, MI (US)

(73) Assignee: Joseph J. Berke, West Bloomfield, MI (US)

( * ) Notice: Subject to any disclaimer, the term of this patent is extended or adjusted under 35 U.S.C. 154(b) by 0 days.

(21) Appl. No.: 09/863,783

(22) Filed: May 24, 2001

(51) Int. Cl.[7] ..... A47G 9/00
(52) U.S. Cl. ..... 5/636; 5/643; 5/646
(58) Field of Search ..... 5/636, 637, 638, 5/646, 643, 644

(56) References Cited

U.S. PATENT DOCUMENTS 3,064,279 A * 11/1962 Finkle ..... 5/636
3,403,414 A * 10/1968 Unger ..... 5/636
3,757,365 A * 9/1973 Kretchmer ..... 5/636
4,432,107 A * 2/1984 Clark et al. ..... 5/636
5,638,564 A * 6/1997 Greenwalt et al. ..... 5/636
5,644,809 A * 7/1997 Olson ..... 5/636
5,727,267 A * 3/1998 Keilhauer ..... 5/636
D444,980 S * 7/2001 Mowat et al. ..... D6/601

* cited by examiner

*Primary Examiner*—Alexander Grosz
(74) *Attorney, Agent, or Firm*—Alex Rhodes

(57) ABSTRACT

An ergonomic pillow for individuals who sleep on their sides. A characterizing feature of the invention is a recess along a lower front portion of the pillow which provides a protective space for a side, sleeper's arms. The pillow is divided into an upper portion and a lower portion which is set back from the upper portion to form the recess. Between the upper and lower portions is a flat planar member which distributes the loads of the side sleeper over the area of the lower pillow portion. In a first aspect of the invention, the protective recess extends across the front portion of the pillow. In further aspects, protective recesses are provided for the shoulders and arms of the side sleeper. A rear portion of the pillow is lowered for sleeping without a recess.

16 Claims, 4 Drawing Sheets

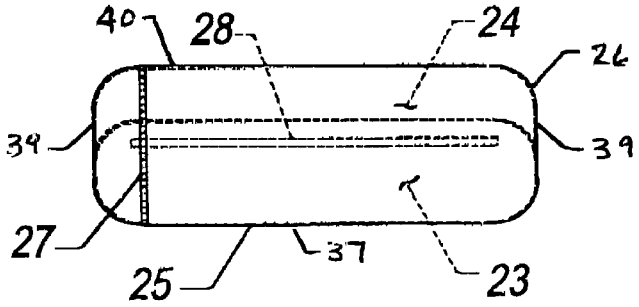
FIG. 1
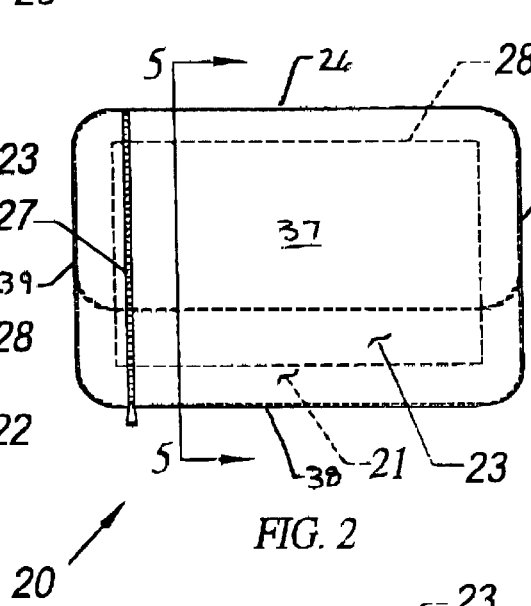
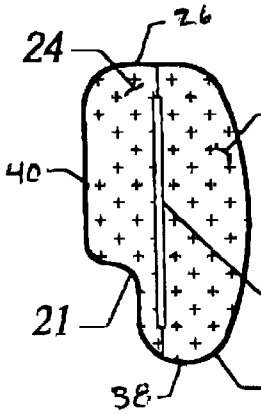
FIG. 5
FIG. 2
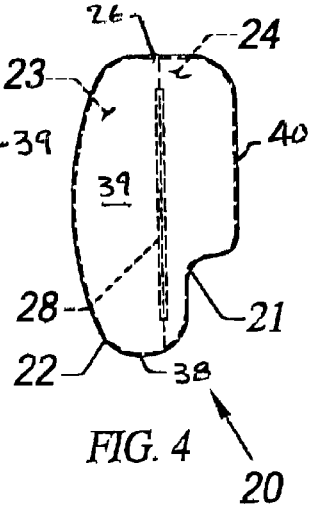
FIG. 4
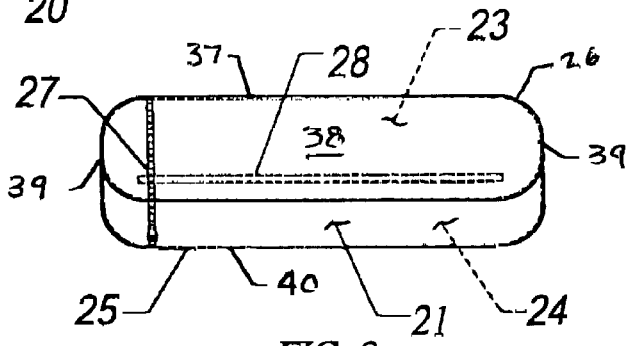
FIG. 3

32

32

ORTHOPEDIC SIDE SLEEPER COMFORT PILLOW AND METHOD

FIELD OF THE INVENTION

This invention relates to orthopedic bedding and more particularly to a pillow for improving comfort and treating sleep deprivation of patients who sleep on their sides.

BACKGROUND OF THE INVENTION

The quality and quantity of sleep strongly affects mental and physical health and feelings of well being. Many individuals prefer to sleep on their sides ("side sleepers") rather than in prone or supine positions. This preference is primarily for comfort, although obesity, impairment, habit, or illness may require this position as well.

Currently, standard and specialized pillows do not adequately provide for a side sleeper's needs or comfort. When the side sleepers head, or head and pillow, rest on his arm and/or shoulder, especially after extended periods of recumbency, pain, dysesthesias and paresthesias often occur. The discomfort and annoyance causes the sleeper to change positions frequently, may awaken him, and may diminish the quality and quantity of sleep. Chronic restlessness and wakefulness can cause sleep deprivation with subsequent diurnal fatigue and depression.

SUMMARY OF THE INVENTION

The present invention is an ergonomic pillow for individuals who sleep on their sides. The pillow reduces discomfort and restlessness to improve the quality and quantity of sleep. Various positions are considered for accommodating the side sleeper's head, neck, shoulder and arm to prevent nocturnal compression of the arm and shoulder. It is a further objective to provide a comfortable pillow which is multi-functional and multi-positionable to accommodate various sleeper positions and recumbent activities.

The invention broadly comprises an ergonomic segmented pillow having upper head and lower base portions enclosed in a thin cover; and a removable outer cover. One distinguishing feature of the invention is that a rigid sheet divides the upper and lower portions. The rigid sheet elevates the side sleepers head and maintains the pillow in a level position by distributing loads across the lower portion of the pillow. Another distinguishing feature of the invention is a recess in the front of the pillow for protecting the side sleepers arm.

In a first embodiment of the invention, a recessed front portion of a pillow extends along the entire length of the pillow. In alternate embodiments, additional recessed portions are provided in the center and opposite ends of the pillow. The pillow may also be used without the recesses by interchanging the front and rear portions of the pillow.

In employing the teaching of the present invention, a plurality of alternate constructions can be adopted to achieve the desired results and capabilities. In this disclosure, only several aspects of the invention are discussed. However, these aspects are intended as examples and should not be considered as limiting the scope of the invention.

Further features and benefits will be apparent by reference to the drawings and ensuing detailed description of a preferred embodiment which discloses the best mode contemplated in carrying out the invention. The exclusive rights which are claimed are set forth in the numbered claims following the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating specific embodiments of the invention by way of non-limiting example only.

FIG. 1 is a rear view of a side sleeper pillow according to the present invention.

FIG. 2 is a plan view of the side sleeper pillow.

FIG. 3 is a front view of the side sleeper pillow.

FIG. 4 is a left end view of the side sleeper pillow.

FIG. 5 is a cross-sectional view taken on the line 5—5 in FIG. 2.

DETAILED DESCRIPTION OF A PREFERRED EMBODIMENT

Figure 6:
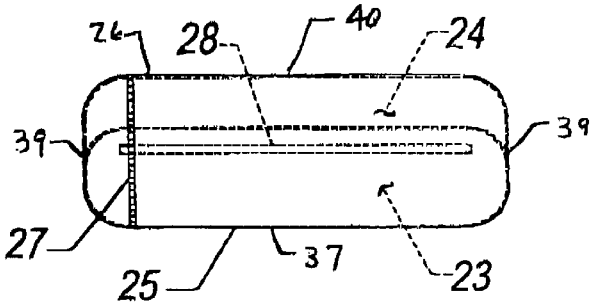
FIG. 6 is a rear view of a second embodiment of the side sleeper pillow.
Figure 10:
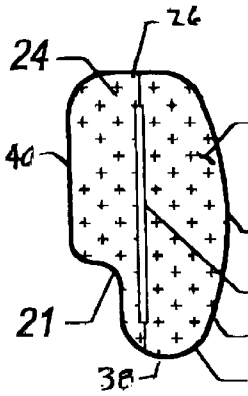
FIG. 10 is a cross-sectional view taken on the line 10—10 in FIG. 7.
Figure 7:
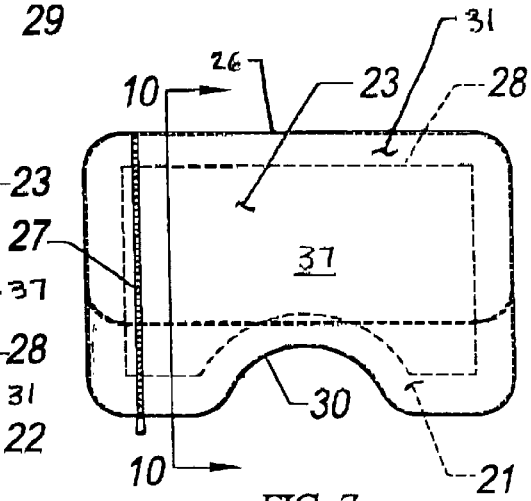
FIG. 7 is a plan view of the second embodiment.
Figure 9:
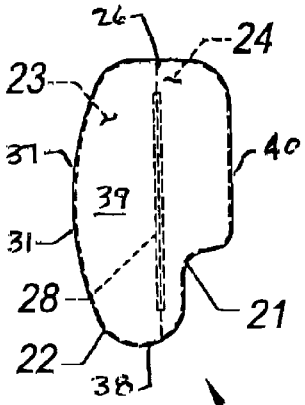
FIG. 9 is a left end view of the second embodiment.
Figure 8:
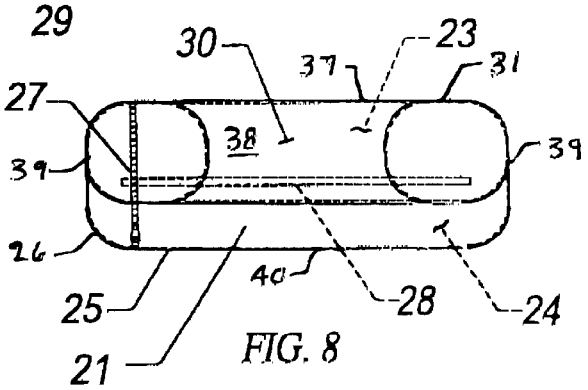
FIG. 8 is a front view of the second embodiment.
Figure 11:
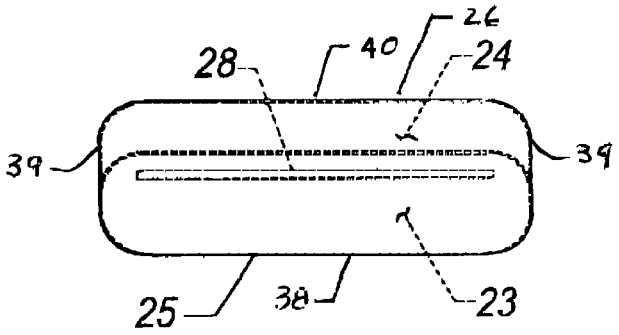
FIG. 11 is a rear view of a third embodiment of the side sleeper pillow.
Figure 15:
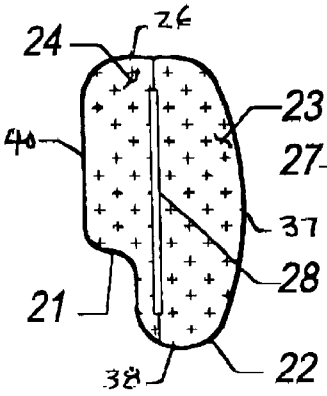
FIG. 15 is a cross-sectional view taken on the line 10—10 in FIG. 12.
Figure 12:
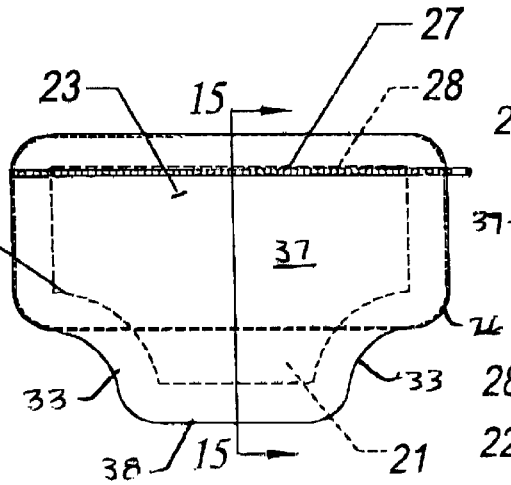
FIG. 12 is a plan view of the third embodiment.
Figure 14:
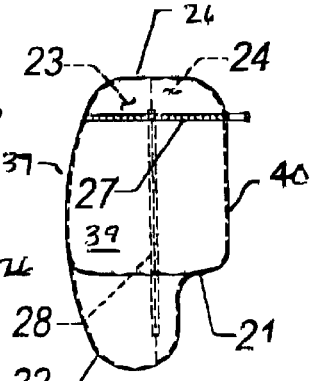
FIG. 14 is a left end view of the third embodiment.
Figure 13:
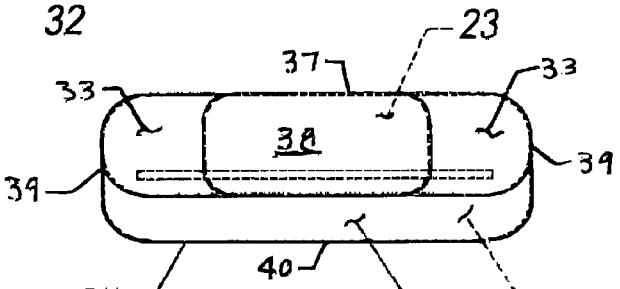
FIG. 13 is a front view of the third embodiment.

In FIGS. 1 through 5, inclusive, a generally rectangular shaped orthopedic pillow 20 is shown, for improving the quality and quantity of sleep of side sleepers. As previously noted, sleep deprivation can lead to diurnal fatigue and depression. "Side sleepers" frequently use arms as head rests, periodically rotating their bodies from side to side because of arm pain, dysesthesias and paresthesias.

With reference to FIG. 4, one distinguishing feature of the pillow is that a front lower portion 21 of the pillow is offset inwardly from a front upper portion 22. The lower recessed portion 21 is a distinguishing feature of the invention. It provides a protected space for the side sleeper's arms and prevents the sleeper's head from loading the arm and inducing pain, dysesthesias and paresthesias. The protected space which is parallel to the front surface of the pillow is adapted to accommodate a side sleeper's arm when the head of the side sleeper is resting on the generally planar top surface of the pillow. The relief of aches and pain reduces tossing and turning, allowing the side sleeper improved rest.

The pillow 20 may take on well known pillow shapes, such as the rectangular shape of FIG. 2, or round, elliptical, or other known shapes, its construction is best understood by referring to FIG. 5. The pillow 20 is a generally rectangular shaped pillow 20 with top 37, front 38, side 39 and bottom 40 surfaces. A resilient upper portion 23 is joined to a resilient lower portion 24 within a thin outer cover 25. The pillow 20 is enclosed in a usual type of slip cover 26, open at one end by a closure such as buttons, VELCRO® or the zipper 27 as shown in FIGS. 1 and 2. Between the upper 23 and lower 24 portions is a thin rigid member 28 which maintains the sleeper's head elevated and the pillow 20 relatively level by distributing loads uniformly over the lower portion 24.

The resiliency of the upper portion 23 is a matter of the sleeper's choice. However, the resiliency of the lower portion should maintain sufficient room in the recess 21 which forms the protective space 21 for the side sleeper's arms. Adequate materials for upper 23 and lower 24 portions are cellular polymers and feathers. Air and water filled cushions may also be used.

Figure 16:
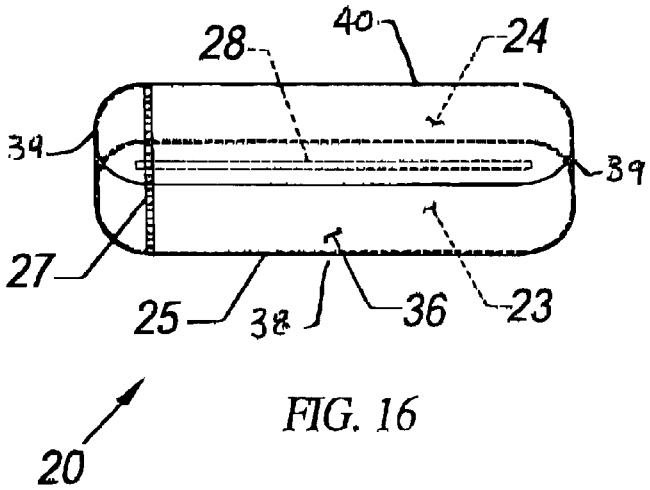
FIG. 16 is a rear view of a fourth embodiment.
Figure 17:
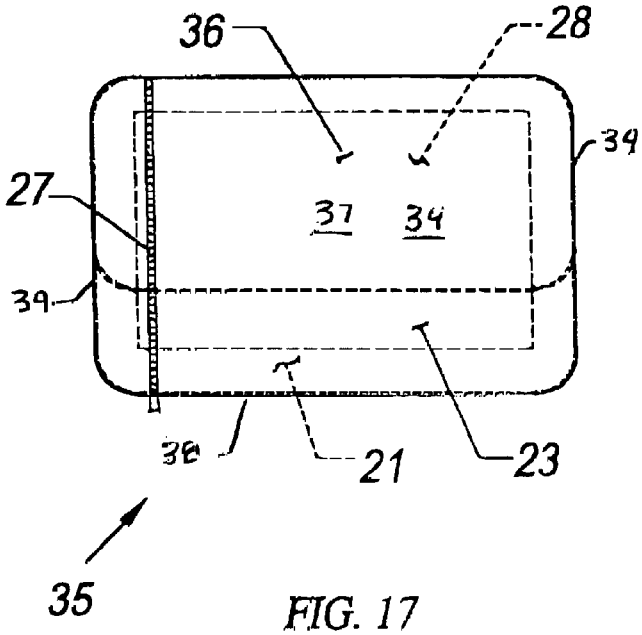
FIG. 17 is a plan view of the fourth embodiment.
Figure 18:
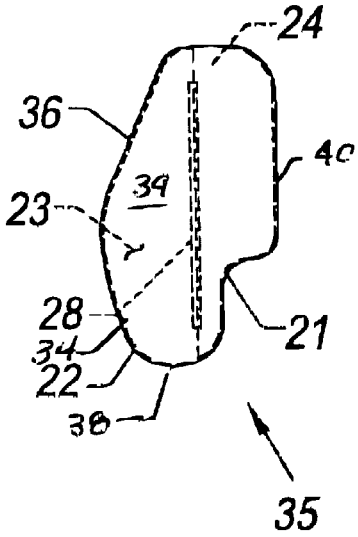
FIG. 18 is a left end view of the fourth embodiment.

With reference to FIGS. 6 through 10, inclusive, an alternate embodiment 29 is shown wherein an additional recess 30 is provided in the center of an upper portion 31 for inducing the sleeper to space his head apart from his arm. In FIGS. 11 through 15 an embodiment 32 is shown wherein the ends 33 of an upper portion 34 are recessed for the side sleeper's shoulders. In FIGS. 16–18, an upper rear portion 36 of the pillow 35 has been lowered to allow a sleeper an option to rotate the pillow 35 by 180 degrees and use the pillow 35 without the protective space 21.

From the above it is apparent that our invention provides a solution for improving the sleep of persons who sleep on their sides. Although only several embodiments have been disclosed, it is apparent that other embodiments can be derived by such changes as substitution of materials, changes of shape and size, re-arrangement of parts, changes of materials and elimination of parts without, departing from the spirit thereof.

We claim:

1. In a pillow for improving the sleep of a side sleeper having a generally planar top surface for supporting a head of said side sleeper, a front surface, a pair of side surfaces and a lower surface for supporting said pillow on a bed, a protective space in a lower front portion of said pillow, said protective space having sufficient height and width to accommodate an arm of said side sleeper inside of said protective space for preventing compression of said arm when said sleeper's head is supported on said top surface, said protective space extending across a front portion of said pillow in parallel relationship to said front surface of said pillow.

2. The pillow recited in claim 1 further comprising a means for distributing loads on said pillow over said lower surface.

3. The pillow recited in claim 2 wherein means for distributing said load is a rigid planar member between said upper and said lower portions of said pillow.

4. The pillow recited in claim 3 wherein said upper and said lower portion of said pillow have substantially a same resiliency.

5. The pillow recited in claim 3 wherein said upper portion has a greater resiliency than said lower portion.

6. The pillow recited in claim 3 wherein said upper portion is a resilient cellular portion.

7. The pillow recited in claim 3 wherein said lower portion is a resilient cellular portion.

8. The pillow recited in claim 1 wherein said protective space has a depth which is about one third of an overall depth of said pillow.

9. The pillow recited in claim 1 further comprising an inward extending recess in a center portion of said upper portion.

10. The pillow recited in claim 1 further comprising a pair of recesses in opposite end portions of said upper portion.

11. The pillow recited in claim 1 wherein said pillow is a generally rectangular shaped pillow.

12. The pillow recited in claim 1 further comprising a removable outer slip cover.

13. In a pillow for improving the sleep of a side sleeper having a generally planar top surface for supporting a head of said side sleeper; a front surface, a pair of side surfaces and a lower surface for supporting said pillow on a bed, a protective space in a lower front portion of said pillow which has sufficient height and width to accommodate an arm of said side sleeper inside of said protective space for preventing compression of said arm when said side sleeper's head is supported on said top surface, said protective space being parallel to said front surface of said pillow and extending across a front portion of said pillow and; a rigid planar member extending across a front portion of said pillow between said upper and said lower surfaces; and a removable cover for receiving said pillow.

14. A method for improving the sleep of a side sleeper comprising the step of placing an arm of said side sleeper in a lower protective space of a pillow which extends across a front portion of said pillow, in parallel relationship to a front surface of said pillow and has sufficient height and width to accommodate said arm in said protective space for preventing compression of said arm when a head of said side sleeper is supported on a top surface of said pillow.

15. The method recited in claim 14 further comprising the step of positioning a head of said side sleeper in a recess in a center portion of an upper portion of said pillow.

16. The method recited in claim 14 further comprising the step of placing a shoulder of said side sleeper in a recess in an end portion of said pillow.

* * * * *